United States Patent [19]

Myers

[11] Patent Number: 4,470,603

[45] Date of Patent: Sep. 11, 1984

[54] ARCHERY TARGET

[76] Inventor: David R. Myers, 9853 Milton Cir., Cypress, Calif. 90630

[21] Appl. No.: 477,757

[22] Filed: Mar. 22, 1983

[51] Int. Cl.[3] ..... F41J 3/00; F41J 7/04

[52] U.S. Cl. ..... 273/390; 273/393

[58] Field of Search ..... 273/390, 391, 392, 393

[56] References Cited

U.S. PATENT DOCUMENTS

| | | | |
|---|---|---|---|
| 2,130,289 | 9/1938 | Phelps | 273/393 |
| 3,647,214 | 3/1972 | Hohmann | 273/392 |
| 4,116,443 | 6/1977 | Dorfman | 273/388 |
| 4,203,600 | 12/1977 | Brown | 273/407 |

FOREIGN PATENT DOCUMENTS

| | | | |
|---|---|---|---|
| 461612 | 6/1928 | Fed. Rep. of Germany | 273/390 |
| 464741 | 10/1968 | Switzerland | 273/393 |

*Primary Examiner*—Anton O. Oechsle

*Attorney, Agent, or Firm*—Holman & Stern

[57] ABSTRACT

A silhouette archery target includes one or more support legs which are supportably received in respective support holes in a base member. The legs and holes are cross-sectionally configured to preclude rotation of the leg in the hole. A rear pivot block is secured to the leg at the base member top surface and has a rearward bottom edge which is located below the center of gravity of the target and serves as a target pivot axis. The forward-facing side of the leg is cut away from just below the top surface of the base member in a manner which permits backward rotation of the target and leg out of the support hole and about the target pivot axis. By selecting the front-to-back depth dimension of the pivot block, one can select the required impact force which causes the target to rotate out of the support hole and topple over. A forward bias block is secured to the leg at the base member top surface to prevent wind directed at the back of the target from toppling the target out of the base member. The blocks may be magnetically or otherwise secured to the leg to permit interchange of different sized blocks and thereby adjust the sensitivity of the target to both arrow impact and wind.

19 Claims, 6 Drawing Figures

ARCHERY TARGET

BACKGROUND OF THE INVENTION

1. Technical Field

The present invention relates to archery targets and, more particularly, to archery targets of the silhouette type. Although the target of the present invention is described in relation to archery, it will be appreciated that the principles of the invention apply equally to darts and other sports in which a projectile is hurled or otherwise projected against a target.

2. The Prior Art

Silhouette shooting is an international firearms sport employing targets configured in the form of silhouettes of animals. These targets are generally fabricated by cutting out the desired silhouette shape from steel and welding the silhouette to a flat plate which forms a base. The base holds the target upright until the silhouette is struck by a bullet which causes the entire assembly to fall or topple over.

There is a current interest in silhouette target shooting for archery. However, since the impact from a bow-launched arrow is considerably less than that produced by a bullet shot from a gun, an archery silhouette target must be made to fall over in response to a smaller impacting force than is the case for a firearm silhouette target. Unfortunately, silhouette targets which are sensitive enough for archery use are also susceptible to toppling from wind. In addition, wind tends to turn the target so that it does not face flush toward the archer. The force required to topple the target is a function of the angle at which the arrow strikes the target, the arrow having its greatest effect when it strikes the target perpendicularly. Unless the target can resist turning in the wind, uniform scoring and standards cannot be established.

It is also a desirable feature, as yet unachieved in archery silhouette targets, that the impact required to topple the target be adjustable in a uniform manner so that national and international standards may be established.

OBJECTS IN SUMMARY OF THE INVENTION

It is an object of the present invention to provide an archery silhouette target which is not subject to rotation by wind.

It is another object of the present invention to provide an archery silhouette target which resists toppling from wind directed from behind and from the sides of the target.

Still another object of the present invention is to provide an archery silhouette target which can be adjusted to respond (i.e. fall over) to different impacting forces.

It is a further object of the present invention to provide an archery silhouette target which can be adjusted to resist toppling due to different prevailing wind forces.

In accordance with the present invention an archery silhouette target includes a silhouette portion supported on at least one support leg. The support leg is received in a support hole of a base member. Cross-section of the leg and hole are selected to preclude rotation of the leg in the hole. In the preferred embodiment the leg and hole both have square or rectangular cross-sections. Front and rear blocks are secured adjacent each leg so as to rest on the top surface of the base member. A forward-facing surface of the leg is cut away from just below the top surface of the base member to permit the leg to rotate about the rear bottom edge of the rear pivot block and out of the support hole when the target is toppled backward under the impact of an arrow. The impact force required to topple the target is adjustable with the front-to-back thickness of the rear block which controls the spacing of the pivot edge or axis from the target center of gravity. Resistance to wind from behind the target is controlled by the depth of the front block. The blocks are preferably removably secured to the target leg so that the sensitivity of any silhouette target to arrow impact and prevailing wind can be adjusted by changing the blocks.

BRIEF DESCRIPTION OF THE DRAWINGS

These and other objects, features and many of the attendant advantages of the invention will be better understood upon a reading of the following detailed description when considered in connection with the accompanying drawings wherein like parts in each of the several figures are identified by the same reference numerals, and wherein.

DESCRIPTION OF THE PREFERRED EMBODIMENTS

Figure 1:
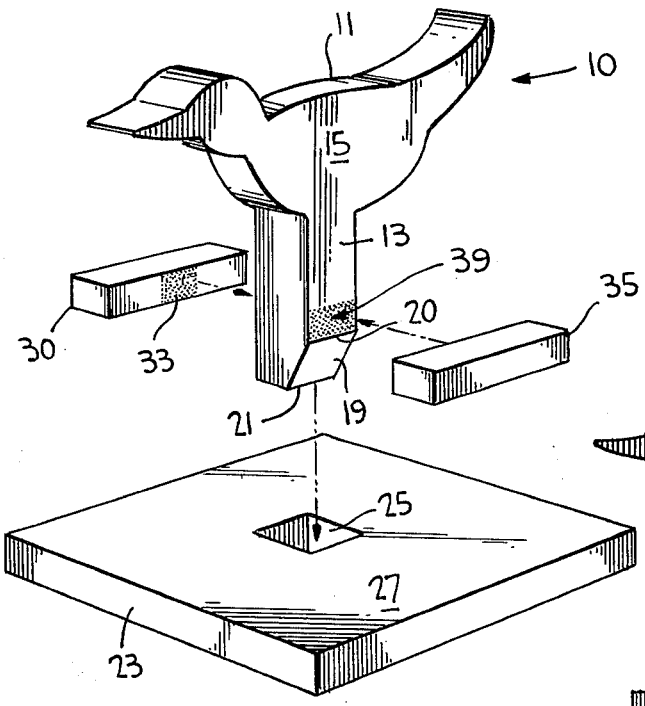
FIG. 1 is an exploded view in perspective of a target assembly of the present invention.
Figure 2:
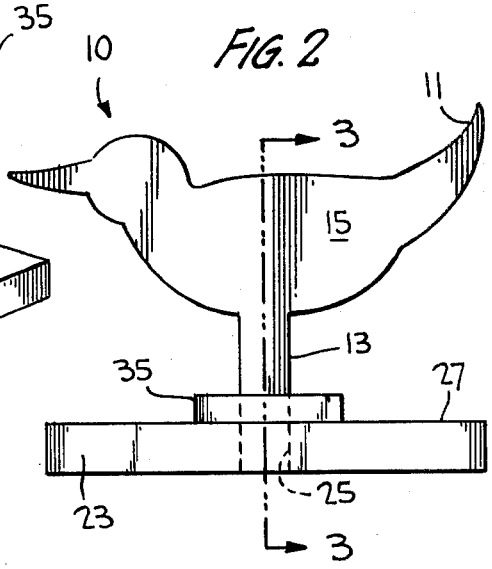
FIG. 2 is a front view in elevation of the target assembly of FIG. 1.

Referring specifically to FIGS. 1–5 of the accompanying drawings, a silhouette target in the form of a bird is generally designated by the reference numeral 10. Target 10 includes a silhouette portion 11 and a depending leg 13. The target is preferably made of wood, plastic, metal or other suitable solid material. A front surface 15 of the target normally faces the archer when the target is deployed for use. A back surface 17 is separated from front surface 15 by the front-to-back thickness of the target which, for example, may be two inches. Leg 13 has the same front-to-back thickness except for the bottom portion of the leg in which the front surface takes the form of a bias plane 19 tapering toward rear surface 17 in a downward direction. Specifically, the bias plane section 19 has a top horizontally-extending and forward-facing edge 20 and a bottom horizontally-extending and forward-facing edge 21. This provides the bottom portion of leg 13 with a generally trapezoidal vertical cross-section in a vertical plane normal to front surface 15 and back surface 17. The horizontal cross-sectional configuration of the illustrated preferred embodiment is square except at the bottom portion of the leg. It is to be understood, however, that this square horizontal cross-section is only one exemplary configuration and that any rectangular, polygonal or other configuration, consistent with the principles of the present invention, may be employed.

A stabilizing base support member 23 takes the form of a solid plate or stand of substantially any peripheral configuration, although a square periphery is illustrated in the preferred embodiment. The height of the base member 23 may be, for example, two inches, the same as the exemplary thickness of target member 10. Base member 23 has a support hole 25 defined therethrough in top-to-bottom direction. It should be noted that hole 25 need not extend entirely through plate 23 but, instead, may be recessed to a pre-determined depth from the top surface 27 of the base member. In either case, the depth of hole 25 must be at least slightly greater (for example, an eighth of an inch greater if the hole is two inches deep) than the vertical height of top edge 20 of bias plane 19 above bottom edge 21. The periphery of hole 25 is generally square to match the square horizontal cross-section of leg 13 so that leg 13 can be inserted into and received by hole 25 and be precluded from rotating therein about any and all vertical axes. In this regard, the periphery of hole 25 need not be square and, in fact, need not match the horizontal cross-sectional shape of leg 13; rather, it is only necessary that the hole be configured, relative to the leg, in a manner that precludes the leg from rotating about any and all vertical axes within the hole.

A rear pivot block 30 is secured to the back of leg 13 at a location above bias plane edge 20 and such that the bottom surface 21 of block 30 rests on top surface 27 of base member 23 when leg 13 is received in hole 25. Although pivot block 30 may be permanently secured to target leg 13, it is preferred that block 30 be removably attached to the leg so that the pivot blocks can be interchanged. For example, as illustrated in FIG. 1, the forward facing surface of block 30 may be treated with a magnetic coating, Velcro or other disengagable layer 33 which mates with and removably engages a similar layer disposed on the rearward-facing surface of leg 13.

A front bias block 35 is secured to the front of leg 13 at a location above bias plane edge 20 and such that the bottom surface 37 of block 35 rests on top surface 27 of base member 23 when leg 13 is received in hole 25. Although bias block 35 may be permanently secured to target leg 13, it is preferred that block 35 be removably attached to the leg so that bias blocks can be interchanged. For example, as illustrated in FIG. 1, the forward-facing surface 15 of leg 13 may be treated with a magnetic coating, Velcro or other disengagable layer 39 which mates with and removably engages a similar layer disposed on the rearward-facing surface of block 35.

Figure 4:
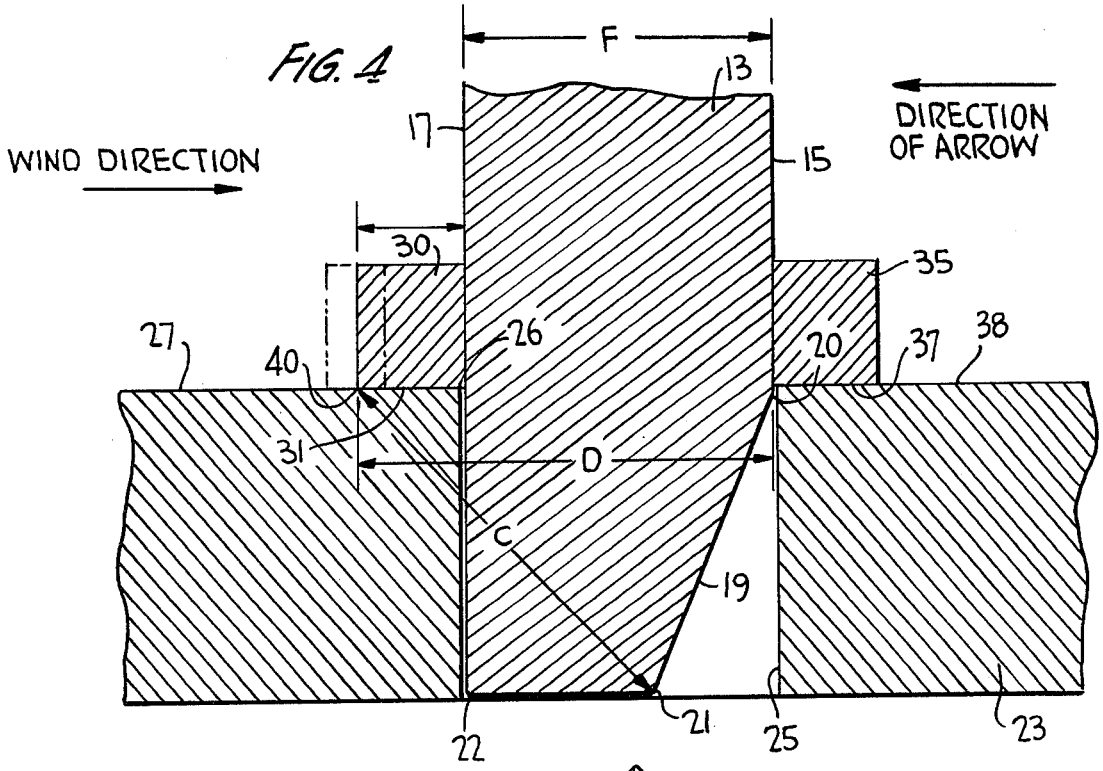
FIG. 4 is a detailed view in section of the bottom portion of the target of FIG. 3 and showing the target deployed for use.
Figure 5:
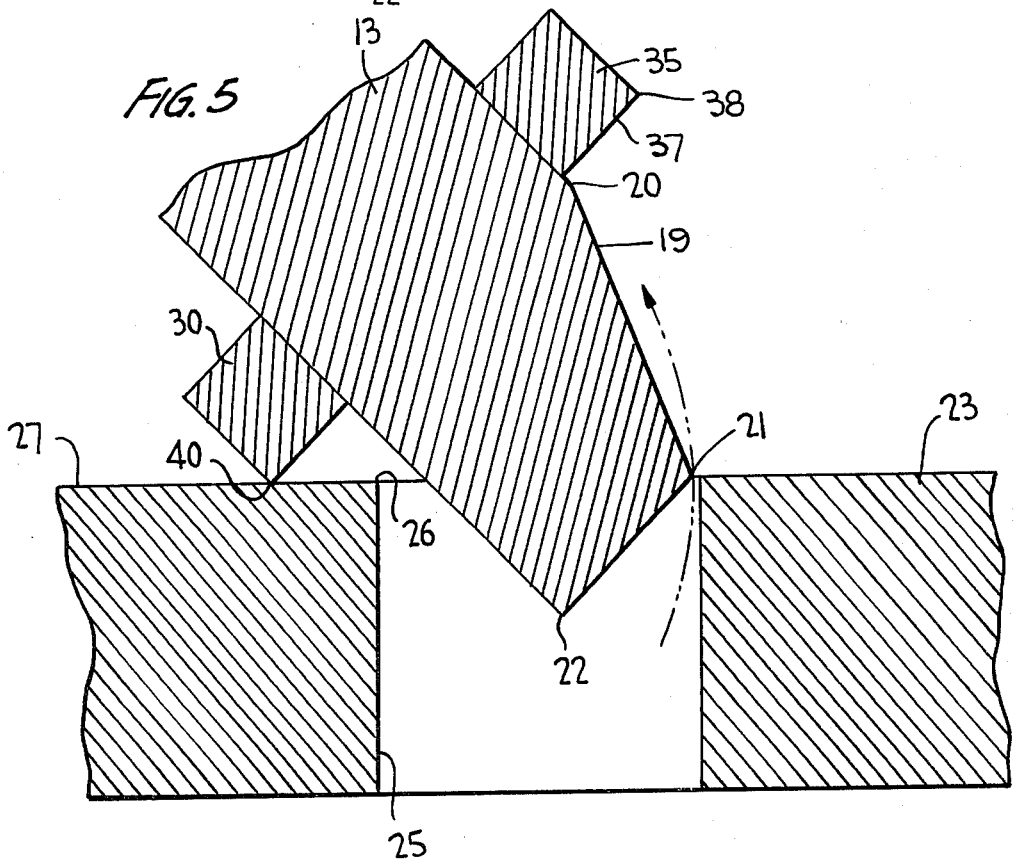
FIG. 5 is a view in section similar to FIG. 4 but showing the target as it is toppling in response to impact from an arrow.

Pivot block 30 and bias block 35 may be elongated side-to-side or in height, or otherwise contoured to provide a pleasing ornamental appearance, as desired. The important dimension of these blocks, however, is their front-to-back dimension along their bottom surfaces 31, 37, respectively. More specifically, and as illustrated in FIGS. 4 and 5, when the target 10 is struck by an arrow or other projectile on its front surface 15, the entire target and blocks 30 and 35 tend to topple by pivoting about the bottom rearward edge 40 of pivot block 30 along the line of contact between edge 40 and top surface 27 of base member 23. In this regard, it is important that the combined center of gravity 41 of target 10 and blocks 30, 35 be located above pivot edge 40 and, preferably, somewhere along leg 13 above block 30, 35. It will be appreciated that the sensitivity of target 10 to toppling is dependent upon the horizontal spacing of pivot edge 40 from the center of gravity 41. This spacing is determined by the front-to-back dimension of block 30. On the other hand, the front-to-back dimension from pivot edge 38 of block 35 to the edge 25 of the opposite side of hole 25 is sufficient to cause leg 13 to contact the opposite side of hole 25 and prevent corner 22 from pivoting around point 38. Thus, to make the target more resistant to toppling from an impacting arrow, a block 30 of greater front-to-back thickness is selected. Similarly, greater resistance to wind from the rear of the target is obtained with blocks 35 of greater front-to-back thickness.

It is important that the bottom of target leg 13 be contoured, relative to the peripheral configuration of hole 25, to permit the bottom of the leg to pivot forwardly upward and out of hole 25 when the target is struck by an arrow. In the illustrated embodiment this is achieved by the bias plane 19; however, any mutual configuration of hole 25 and leg 13 which permits toppling of the target without permitting rotation of the target about a vertical axis is within the scope of this invention. In the illustrated embodiment, in order for the bottom of leg 13 to clear the periphery of hole 25 when the target is toppled, it is important that dimension C of FIG. 5 be equal to or smaller than dimension D. Dimension C is the point-to-point distance between the bottom edge 21 of bias plane 19 and the bottom pivot edge 40 of pivot block 30. Dimension D is the horizontal spacing between top edge 20 of bias plane 19 and pivot edge 40. This relationship between dimensions C and D permits bottom edge 21 to clear the edge of hole 25 at surface 27 when a target topples due to arrow impact. In addition, upper edge 20 of bias plane 19 should be no higher, and is preferably lower, than surface 27 so that, for the illustrated embodiment, the full front-to-back thickness F of leg 13 above bias plane 19 resides at least partially in hole 25. If edge 20 resides above surface 27, the thickness of leg 13 in hole 25 is effectively reduced, thereby permitting too much slack between the leg and hole periphery and reducing the resistance of the target to rearwardly-applied wind.

Figure 6:
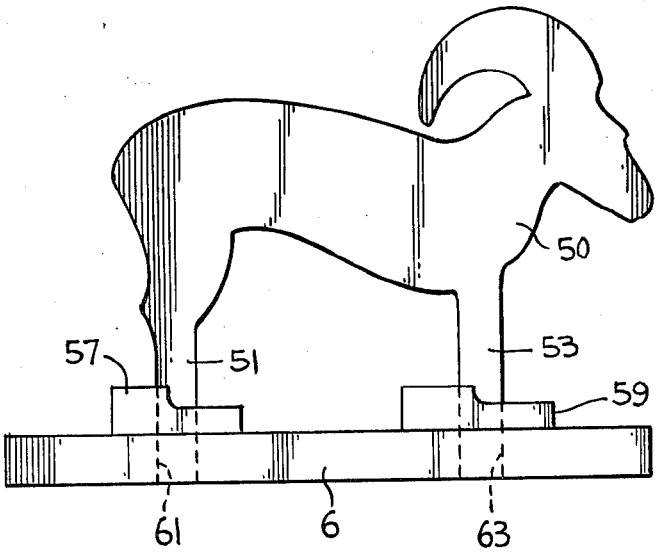
FIG. 6 is a front view in elevation of an alternative target embodiment of the present invention wherein two legs are employed for the target silhouette.
Figure 3:
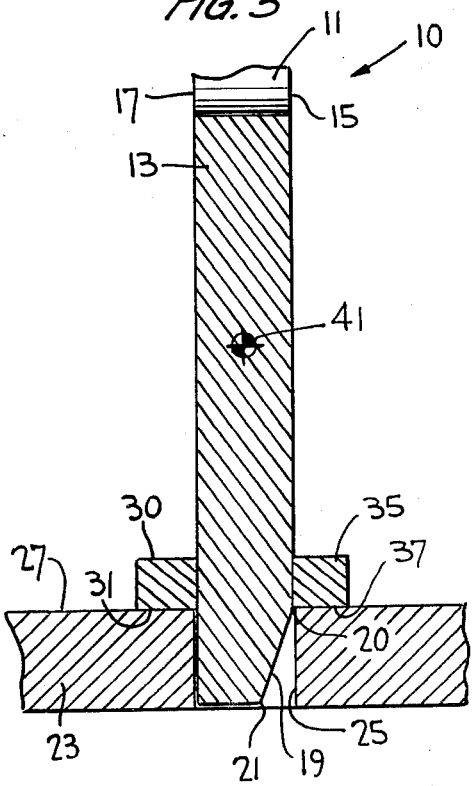
FIG. 3 is a view in section taken along lines 3—3 of FIG. 2.

The target of the present invention can be provided with virtually any silhouette configuration and any number of legs. For example, a goat silhouette 50 is illustrated in FIG. 6 with two legs 51, 53 instead of the single leg 13 of the embodiment of FIG. 1. Front bias blocks 57, 59 are provided, one for each leg, as are rear pivot blocks (not visible in FIG. 6). Base member 60 is provided with two support holes 61, 63, spaced and configured to receive respective legs 51, 53. The structural and operating features described above relating support leg 13 to support hole 25 applies to each of legs 51, 53 and their respective support holes 61, 63.

This invention described herein is a silhouette target which:

(1) allows the target to be held in such a fashion that all targets face the archer exactly without deviation;

(2) permits the target to be adjusted to compensate for prevailing wind so that the target does not fall over in the wind; and (3) permits the amount of impact required to topple the target to be adjusted within the target assembly itself.

The impact necessary to topple the target is fully adjustable. By lengthening the front-to-back dimension of block 30, the amount of impact necessary to push over the target is increased. By shortening this dimension the necessary impact is reduced. Adjustments to this dimension are independent of the similar dimension in block 35 and has no effect on the wind resistance function. The operation of the blocks 30, 35 is based on a lever principle. The changing of the front-to-back dimension of the block is actually a lengthening or shortening of the lever distance that extends from the center of mass 41 of the target to the pivot edge 40. In order for the target to fulcrum over the pivot edge 40 and fall over, the mass of the target must be swung in an arc about the pivot edge. This necessitates lifting the entire mass of the target out of the hole 25 in base 23. As the length of the lever distance is increased, more and more force is required to lift the same amount of mass out of the hole and over pivot axis 40.

It will be appreciated that the target of the present invention is not attached to a simple flat base, but instead is held in a strict configuration in relationship to the archer by being mounted freely within a fixed base. By utilizing the blocks 30, 35 on each side of the legs, the impact necessary to topple the target can be adjusted to achieve maximum performance out of the silhouettes. Above all, silhouette targets can now be adjusted so that all silhouettes shot at all times and at all places topple over from the same amount of impact. This uniform response of the targets is critical for establishing national and international award systems. Further, by utilizing the contoured configuration of the leg bottom inside the support hole, it is possible to secure the target so that it cannot be pushed over by the wind in any direction, other than the direction of an impacting arrow.

Having described several embodiments of a new and improved archery target constructed according to the present invention, it is believed that other modifications, variations and changes will be suggested to those skilled in the art in light of the above teachings. It is therefore to be understood that all such variations, modifications and changes are believed to come within the scope of the present invention as defined in the appended claims.

What is claimed is:

1. A target assembly for a projectile such as an archery arrow, comprising:

a target member including a silhouette portion and at least one leg depending from said silhouette portion, said target member having relatively large front and back surfaces, relatively narrow side surfaces and a center of gravity;

a base member having a top surface and at least one support hole defined through said top surface, said support hole being configured to receive said leg to permit free vertical movement of said target member, to prevent rotation of said leg in said support hole about all vertical axes and such that the center of gravity of said target member is above said top surface;

a rear pivot block secured to said leg at the back surface of said target member and having a bottom surface which is adjacent to the top surface of said base member when said leg is received in said support hole, said bottom surface of said rear pivot block having a rearward pivot edge; and wherein said leg is contoured relative to said support hole to permit said leg to be rotated up and out of said support hole when said target member is pivoted backward about said rear ward pivot edge.

2. A target according to claim 1 further comprising a front block secured to said leg at the front surface of said target member and having a bottom surface which is adjacent to top surface of said base member when said leg is received in said support hole, whereby said front block resists toppling of said target member in response to forces applied to said back surface.

3. A target according to claim 2 wherein said front and rear blocks are selectively removable from said leg to permit replacement of said blocks with other blocks of different front-to-back dimensions.

4. A target according to claim 2 wherein said support hole has a generally rectangular periphery and said leg has a matching generally rectangular horizontal cross section along at least a portion of its length.

5. A target according to claim 4 wherein the contour of said leg includes a generally trapezoidal vertical cross-section wherein the front surface of said target member at the bottom of said leg is downwardly tapered to converge generally toward the back surface of the target member in a downward direction.

6. A target according to claim 5 wherein the downward taper of the front surface at said leg begins at a predetermined height along said leg which is slightly below the top surface of said base member when said leg is received within said support hole.

7. A target according to claim 6 wherein the downward taper in the front surface at said leg terminates in a bottom front edge of said leg, and wherein the distance between said bottom front edge of said leg and said rearward pivot edge of said pivot block is equal to or less than the distance from the front surface of the leg at said pre-determined height to said pivot edge of said rear pivot block.

8. A target according to claim 7 wherein the center of gravity of said target member is within said silhouette portion.

9. The target according to claim 8 further comprising a plurality of pivot blocks interchangeable with said rear pivot block, each of said plurality of pivot blocks and said rear pivot block having a different front-to-back dimension along its bottom surface.

10. A target according to claim 9 further comprising a plurality of bias blocks interchangeable with said front block, each of said bias blocks and said front block having a different front-to-back dimension along its bottom surface.

11. A target according to claim 2 wherein said support hole has a generally polygonal periphery and said support hole has a matching generally polygonal horizontal cross-section along at least a portion of its length; and wherein the front surface of said target member at the bottom of said leg is downwardly tapered to converge generally toward the back surface of the target member in a downward direction.

12. A target according to claim 11 wherein the downward taper in the front surface at said leg begins at a predetermined height along said leg which is slightly below the top surface of said base member when said leg is received within said support hole;

wherein the downward taper in the front surface at said leg terminates in a bottom front edge of said leg; and wherein the distance between said bottom front edge of said leg and said rearward pivot edge of said pivot block is equal to or less than the distance from the front surface of the leg at said predetermined height to said pivot edge of said pivot block.

13. A target according to claim 12 further comprising a plurality of pivot blocks interchangeable with said rear pivot block, each of said plurality of pivot blocks and said rear pivot block having a different front-to-back dimension along its bottom surface.

14. A target according to claim 12 further comprising a plurality of bias blocks interchangeable with said front block, each of said bias blocks and said front block having a different front-to-back dimension along its bottom surface.

15. A target according to claim 1 wherein said support hole has a generally polygonal periphery and said leg has a matching generally polygonal horizontal cross-section along at least a portion of its length; and wherein the front surface of said target member at the bottom of said leg is downwardly tapered to converge generally toward the back surface of the target member in a downward direction.

16. A target according to claim 15 wherein the downward taper in the front surface at said leg begins at a predetermined height along said leg which is slightly below the top surface of said base member when said leg is received within said support hole;

wherein the downward taper in the front surface at said leg terminates in a bottom front edge of said leg; and wherein the distance between said bottom front edge of said leg and said rearward pivot edge of said pivot block is equal to or less than the distance from the front surface of the leg at said predetermined height to said pivot edge of said pivot block.

17. A target according to claim 1 further comprising a plurality of pivot blocks interchangeable with said rear pivot block, each of said plurality of pivot blocks and said rear pivot block having a different front-to-back dimension along its bottom surface.

18. A method of supporting a silhouette target for use in archery, said method comprising the steps of:

inserting a depending leg of a silhouette target into a support hole of a support base such that the target is precluded from rotating about all vertical axes but is pivotable rearwardly about a horizontal axis such that the leg is pivotable up and out of the support hole; and securing interchangeable rear pivot blocks of various front-to-back dimensions to said leg in contact with the top surface of said support base to define horizontal pivot axes for said silhouette target at the locations where the rear bottom edges of the secured pivot blocks contact the support base top surface.

19. The method according to claim 18 further including the step of securing interchangeable front pivot blocks to said leg in contact with said support base to prevent forward pivoting of said target.

* * * * *